United States Patent [19]

Barlow

[11] Patent Number: 5,058,086

[45] Date of Patent: Oct. 15, 1991

[54] RECREATIONAL TIMING APPARATUS

[75] Inventor: Gordon A. Barlow, Highland Park, Ill.

[73] Assignee: Rapid Mounting and Finishing Company, Cadaco Division, Chicago, Ill.

[21] Appl. No.: 674,070

[22] Filed: Mar. 21, 1991

[51] Int. Cl.[5] ..... G04F 1/00; G04B 37/00

[52] U.S. Cl. ..... 368/98; 368/109; 368/317

[58] Field of Search ..... 368/72-74, 368/97-98, 107-109, 243, 244, 262, 276, 316-317

[56] References Cited

U.S. PATENT DOCUMENTS

| | | | |
|---|---|---|---|
| 1,381,225 | 6/1921 | Pfeifer | 368/262 |
| 3,797,223 | 3/1974 | Oliveri | 368/262 |
| 4,449,833 | 5/1984 | Montgomert | 368/317 |

*Primary Examiner*—Vit W. Miska
*Attorney, Agent, or Firm*—Wood,Phillips,Mason,Recktenwald & Vansanten

[57] ABSTRACT

A timing apparatus for giving an indication of the passage of a preselected time interval, which timing apparatus consists of a body to be supported on a surface, a timer mechanism on the body including a trigger that is movable between a) a set position and b) a return position, structure on the timing mechanism for moving the trigger from its set position to its return position within a preselected time interval, and structure for repositioning the body relative to a support surface for the body as an incident of the trigger moving from its set position into its return position, with the body in an operative position on a support surface for the body, to give a visual indication of the passage of the preselected time interval.

20 Claims, 3 Drawing Sheets

RECREATIONAL TIMING APPARATUS

BACKGROUND OF THE INVENTION

1. Field of the Invention

This invention relates to timing apparatus for giving an indication of the passage of a preselected time interval and, more particularly, to a recreational timing apparatus which gives a clear, visual indication of the end of the preselected time interval.

2. Background Art

Those in the highly competitive game industry are constantly seeking ways of making games more entertaining to the users thereof. Because the players in many games are "racing the clock", the interval timer is a common game piece.

Heretofore, interval timers in the game industry have generally been unimaginative. The game user normally presets a numbered dial to the desired time interval, at the end of which a buzzer or bell sounds, thereby alerting the user to the passage of the preselected time interval.

SUMMARY OF THE INVENTION

The present invention is specifically directed to overcoming the above problem in a novel and simple manner.

The principal objective of the present invention is to provide an affordable, yet highly entertaining timing apparatus, which, while capable of being used in other environments, is particularly adaptable as part of a board game.

More particularly, the present invention is directed to a timing apparatus for giving an indication of the passage of a preselected time interval, which timing apparatus consists of a body to be supported on a surface, a timer mechanism on the body including a trigger that is movable between a) a set position and b) a return position, structure on the timing mechanism for moving the trigger from its set position to its return position within a preselected time interval, and structure for repositioning the body relative to a support surface for the body as an incident of the trigger moving from its set position into its return position, with the body in an operative position on a support surface for the body, to give a visual indication of the passage of the preselected time interval.

The repositioning structure includes a lifting arm that is movable relative to the body between first and second positions. The lifting arm is positionable in its first position with the trigger in its set position. There is cooperating structure on the trigger and lifting arm for driving the lifting arm from its first position into its second position as an incident of the trigger moving from its set position into its return position to thereby cause the lifting arm to act against the surface on which the body is supported and thereby reposition the body.

The body has a top side and a bottom side. The timing apparatus, in its operative position, is supported in a top side up position relative to a subjacent surface with the lifting arm in its first position. As the lifting arm moves from its first position to its second position, the lifting arm acting against the subjacent surface flips the timing apparatus over into a bottom side up position on the subjacent support surface.

The trigger is normally biased towards its return position.

The timing mechanism also includes a ratchet structure for producing an audible clicking noise indicative of movement of the trigger from its set position to its return position.

In a preferred form, the lifting arm is a U-shaped element defining a U-shaped edge for supporting the timing apparatus on a subjacent support surface with the lifting arm in its first position.

The top side of the body is substantially flat to make facial engagement with a flat subjacent support surface with the body in its top side down position.

The ratchet structure, in addition to producing an audible clicking noise, prevents unimpeded movement of the trigger from its set position to its return position.

Preferably, the ratchet structure includes a first rotatable gear and a ratchet arm that acts against the first rotatable gear. The ratchet arm has a nose that moves repetitively into and out of engagement with the first gear between adjacent teeth on the first gear as the trigger moves between its set position and its return position.

The timer mechanism preferably includes a second gear and a transition gear in mesh between the first and second gears.

Preferably, the timer mechanism has a setting gear acting between the trigger and the second gear. There is cooperating structure on the second gear and setting gear to allow the setting gear to move in one rotational direction relative to the second gear without moving the second gear and to cause the second gear to follow pivoting movement of the setting gear as the setting gear moves in a rotational direction opposite to the one direction. There is cooperating structure on the setting gear and trigger for causing the setting gear to move in the one rotational direction as the trigger is moved from its return position to its set position.

Preferably, the cooperating structure on the setting gear and trigger includes cooperating teeth. The teeth on the trigger disengage from the setting gear as the trigger approaches its return position to allow the trigger to be positively driven, without resistance, into its return position.

Preferably, the biasing structure for the trigger is a coil spring connected between the body and the trigger.

The invention also contemplates a timing apparatus for giving an indication of the passage of a preselected time interval, which timing apparatus consists of a body to be supported on a surface, a timer mechanism on the body including a trigger that is movable between a) a set position and b) a return position, structure on the timer mechanism for moving the trigger from its set position to its return position within a preselected time interval, an arm on the body that is movable relative to the body between first and second positions, and structure for moving the arm from its first position to its second position as an incident of the trigger moving from its set position to its return position. The arm is exposed outside of the body in its second position and, upon being moved from its first position to its second position, gives a visual indication of the passage of a preselected time interval.

Preferably, the body has an elongate slot and a part of the trigger projects through the slot to allow manual repositioning of the trigger by a user.

With the trigger in its set position, the arm is freely movable between its first and second positions without interference from the trigger.

DETAILED DESCRIPTION OF THE DRAWINGS

Figure 1:
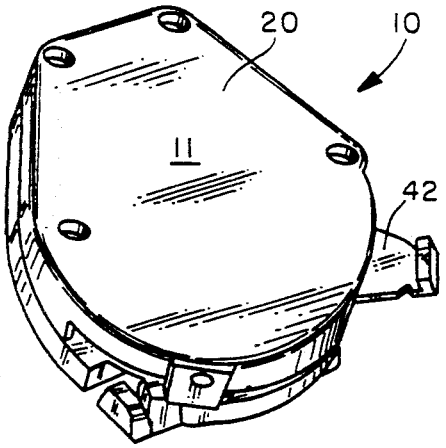
FIG. 1 is a perspective view from the bottom of a timing apparatus according to the present invention.

A timing apparatus, according to the present invention, is shown at 10 in FIGS. 1–8. The timing apparatus 10 has a body/housing 11 consisting of upper and lower body parts 12, 14, respectively, which cooperatively bound a space 16 for a timer mechanism 18. The body 11 is shown to have a generally circular configuration. The particular configuration for the body 11 is, however, principally a design consideration.

The body 11 has a flat upper surface 20 and an oppositely facing, flat, bottom surface 22. A U-shaped lifting arm 24 has its legs 26, 28 connected to lugs 30, 32, integrally formed on the lower body part 14, for pivoting movement about an axis 34 that is generally parallel to the planes of body surfaces 20, 22. The lifting arm 24 is pivotable between a first position, shown in phantom in FIG. 5, and a second position, shown in solid lines in the same figure.

In the first lifting arm position, a flat edge 36 on the arm 24 bears on the bottom surface 22 of the body 11 to situate an oppositely facing, planar edge 38 on the lifting arm 24 generally parallel to the planes of the body surfaces 20, 22. The edge 38 defines the support for the timing apparatus 10 on a flat, subjacent support surface 40.

The timing apparatus 10 is actuated by a trigger 42, that projects through an elongate slot 44 in the body 11. The trigger 42 is pivotable about an axis 46 between the set position, shown in phantom lines in FIG. 7, and a return position, shown in solid lines in the same figure.

In operation, the trigger 42 is first moved from its return position, into which it is normally biased by a coil spring 48, against the spring bias to the set position. Through the timer mechanism 18, which will be described in detail below, the trigger 42 moves slowly and continuously towards the return position, which movement is accomplished in a preselected time interval.

In the embodiment shown, the trigger 42 pivots through a range of about 140° between the set and return positions therefore. The trigger 42 is controlled in rotation through approximately 150° of rotation. Over the last 25° of movement of the trigger 42, as it approaches the return position therefore, the trigger 42 pivots freely and is positively driven into its return position by the spring 48. As this occurs, the trigger end 50 that projects out of the body 11, engages and drives a trip arm 42 on the lifting arm 24 to thereby drive the lifting arm 24 from its first position, in the direction of arrow 53 in FIG. 5, into its second position. This action drives the edge 38 on the lifting arm 24 against the subjacent support surface 40 whereupon the body 11 is forced away from the support surface 40 in a clockwise direction in FIG. 5, as indicated by arrow 54, about the axis 34. Once the lifting arm 24 is in its second position, the larger mass of the body 11 draws the lifting arm 24 together therewith in the clockwise direction. The spring force for spring 48 is chosen so that the force exerted by the lifting arm 24 is sufficient to turn the body 11 completely over so that the upper surface 20 thereon facially abuts the support surface 40.

The biased trigger 42 maintains the lifting arm 24 in its second position with the timing apparatus 10 in an upside down position. The lifting arm 24 is shown to have an enlarged web 56, suitable for fitting a phrase, or the like, that relates to the particular board game. In the embodiment shown, the words "Time's Up!" are shown.

Figure 6:
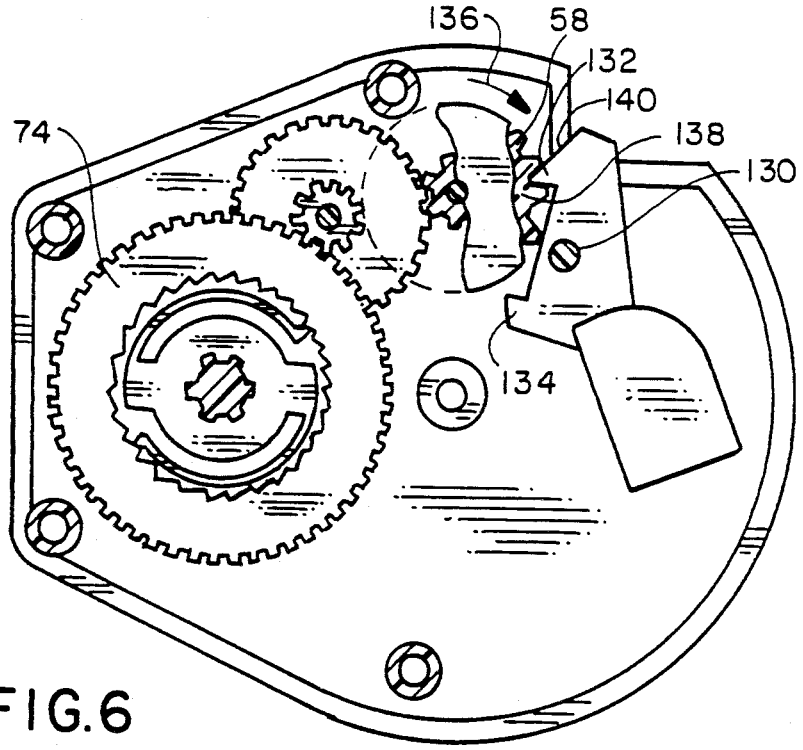
FIG. 6 is an enlarged plan view of a ratchet mechanism on the bottom part of a separable body on the timer mechanism.

That part of the timer mechanism 18 which controls pivoting movement of the trigger 42 is described below with respect to FIGS. 6–8. A first ratchet gear 58 is mounted on a post 60 integrally formed on the lower body part 14. The first gear 58 has a stepped configuration with a first diameter upper gear part 62 and a lower, concentric, smaller gear part 64. The first gear 58 is in mesh with a transition gear 66 pivotably mounted about a post 68 on the lower body part 64. The transition gear 66 has substantially the same configuration as the first gear 58 but is inverted so that the lower gear part 70, having the larger diameter, meshes with the smaller gear part 64. The upper gear part 72 on the transition gear 66 meshes with the upper gear part 62 on the first gear 58.

The part 72 of the transition gear 66 is in mesh with a second gear 74, having a diameter larger than the gears 58, 66. The second gear 74 has a toothed undercut 76 for reception of a setting gear 78, which has a stem 80 that extends through a bore 82 in the second gear 74 and into a bore 84 on the body part 14 to guide rotation of the second gear 74 about an axis 86 that is parallel to and spaced from the rotational axes 88, 90 for the gears 58, 66, respectively.

A flat partition 90, having a cross section substantially matched to the body part 14, maintains the gears 58, 66, 74, 78 in meshed, operative relationship. The setting gear 78 has an actuating gear 94 projecting upwardly therefrom and through the partition 92 to be exposed above the top surface 96 of the partition 92. A shroud 98 supports the upper shaft end 100 of the setting gear 78 and is cut away at 102 to expose the actuating gear 94. The exposed actuating gear 94 is in mesh with gear teeth 104 on the inside end 106 of the trigger 42.

A stud 108 projects upwardly from the partition 92 into a bore 110 on the trigger 42 to guide the trigger 42 in rotation between its set and return positions. The coil spring 48 has its opposite ends 112, 114 attached to U-shaped mounting posts 116, 118, on the trigger 42 and partition 92, respectively. The coil spring 48 exerts a constant bias on the trigger 42 in the counterclockwise direction in FIG. 8.

Figure 7:
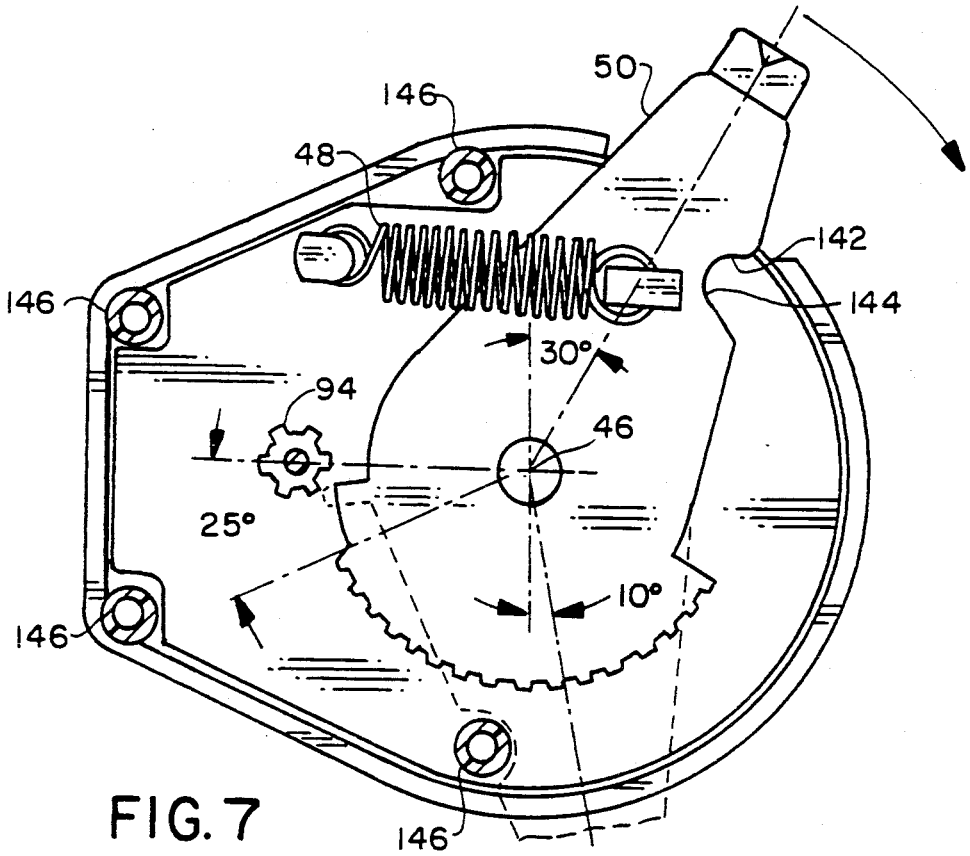
FIG. 7 is a view as in FIG. 6 with a trigger for operating the timing mechanism shown in a set position in phantom and in a return position in solid lines.
Figure 8:
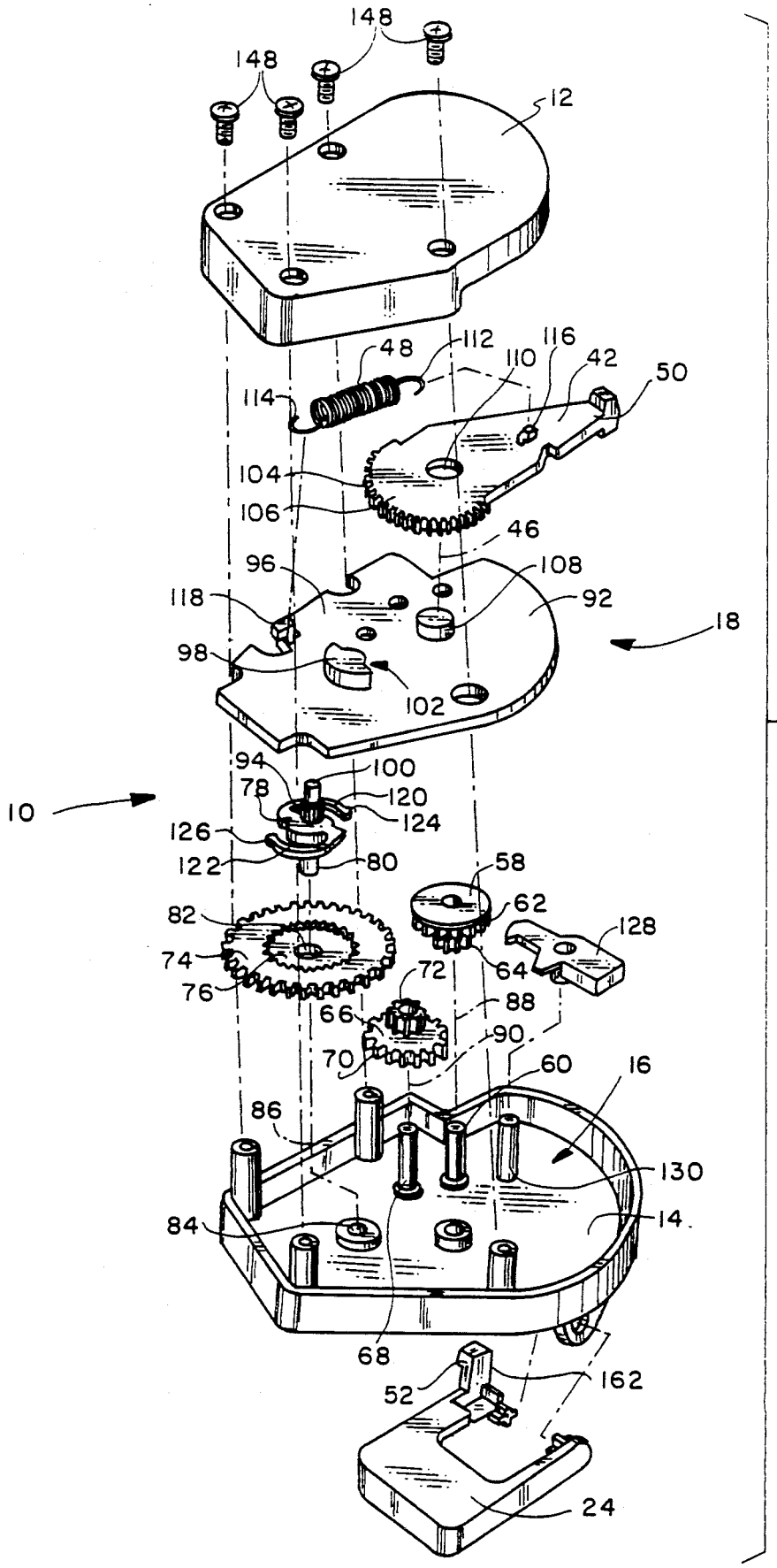
FIG. 8 is an exploded perspective view of the timing apparatus.

Timing apparatus 10 is set by pivoting the exposed trigger end 50 in a clockwise direction in FIGS. 7 and 8. As this occurs, the teeth 104 on the trigger 102 drive the actuating gear 94 on the setting gear 78 in a counterclockwise direction in FIGS. 7 and 8. The gear 78 is constructed to allow counterclockwise pivoting relative to the gear 74 without causing the gear 74 to rotate therewith. This is permitted by constructing the setting gear 78 in an S shape with bendable, oppositely projecting legs 120, 122, with gear engaging noses 124, 126 thereon. Rotation of the setting gear 78 in a counterclockwise direction causes the noses 124, 126 to be cammed inwardly so as to bend the arms 120, 122 out of engagement with the teeth on the gear 74. As the setting gear 78 moves in a clockwise direction, the cam surfaces on the noses 124, 126 cause the legs 120, 122 to deflect radially outwardly and between the teeth with which they mesh.

Once the trigger 42 is set, the spring 48 biases the trigger 42 back towards its return position. As the trigger 42 moves in the counterclockwise direction, it moves in turn the setting gear 78, second gear 74, transition gear 66 and first gear 58. The cooperating gears 78, 74, 66, 58 produce a substantial resistance to rotation of the trigger 42 so that the trigger 42 moves slowly towards its return position.

To further inhibit pivoting of the trigger 42 and to at the same time produce an audible clicking noise indicative of the timing apparatus being in operation, a ratchet arm 128 is provided. The ratchet arm 128 is mounted for pivoting movement about a post 130 on the body part 14. The ratchet arm 128 has a nose 132 and a deflecting leg 134 on diametrically opposite sides of the post 130. As the timing apparatus 10 is operating, the gear 58 is rotating in a clockwise direction, as indicated by arrow 136 in FIG. 6. As rotation of the gear 48 occurs, the teeth 138 thereon engage and deflect a cam surface 140 on the nose 132. This drives the ratchet arm 128 in a clockwise direction about the post 130 whereupon the leg 134 moves into engagement with the gear teeth 138. The deflecting leg 134 is in turn cammed out of engagement with the gear 58 as the gear 58 continues to rotate. In so doing, the nose 132 is deflected back into engagement with the gear 58. The ratchet arm 128 thus trips back and forth into engagement with the gear 58 to produce a clicking noise as the nose 132 and leg 134 move repetitively into and out of engagement with the gear teeth 138. To limit movement of the trigger 42 and consistently place the trigger 42 in a set position for the maximum time interval, a notch 142 is provided in the trigger 42. The notch 142 defines a curved edge 144 which conforms to the outer periphery of one of four mounting posts 146 on the body part 14, which posts are tapped to accept fasteners 148 that maintain the body parts 12, 14 together.

Figure 2:
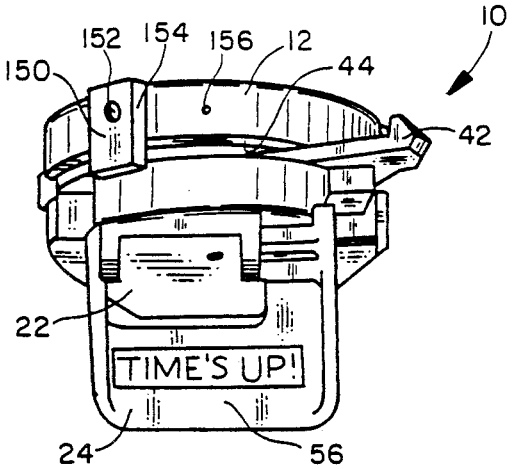
FIG. 2 is a front perspective view of the timing apparatus.
Figure 3:
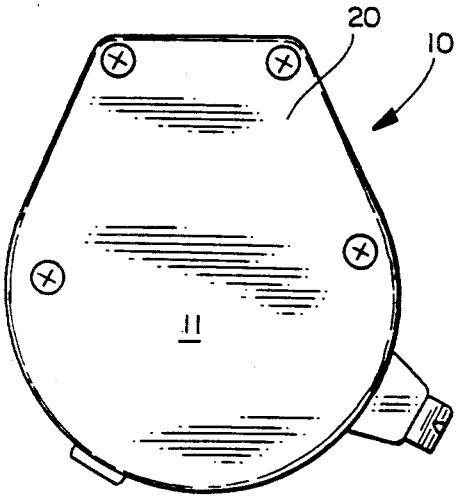
FIG. 3 is a plan view of the timing apparatus.
Figure 4:
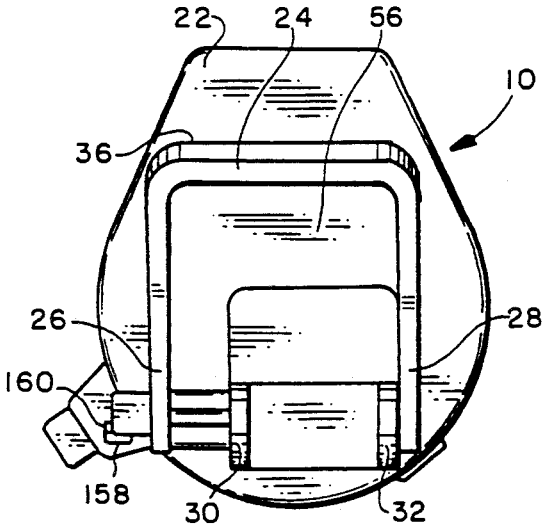
FIG. 4 is a bottom view of the timing apparatus.
Figure 5:
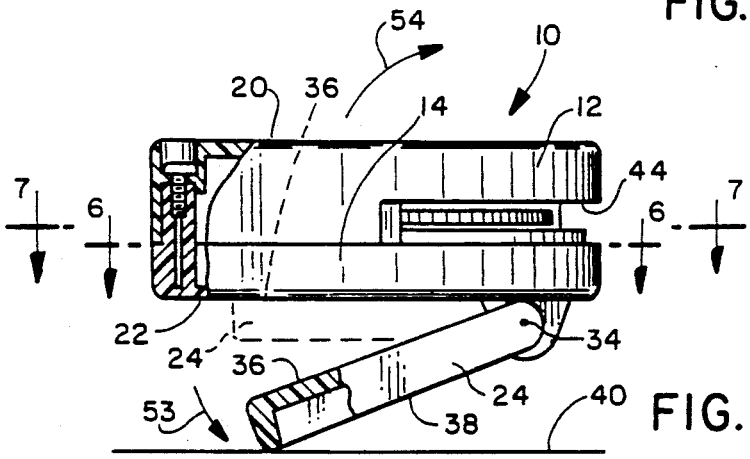
FIG. 5 is a side elevation view of the timing apparatus.

An optional tab 150 is provided and is pivotably connected through a pin 152 to the body part 12 into the position in FIG. 2 wherein a blocking edge 154 thereon extends across the slot 44 to prevent the trigger 42 from being moved to the phantom line position of FIG. 7. This reduces the travel range for the trigger 42 and thus the time interval in which the trigger 42 moves back to its return position. The tab 150 is pivotable about the pin 52 through approximately 90° to move the blocking wall 154 out of the path of the trigger 42. The tab 150 can be placed at any location along the slot 44 to create a desired timer interval for movement of the trigger 42 from its set position back to its return position. An alternative receptacle 156 for the pin 152 is shown in FIG. 2.

To facilitate camming of the support arm 30 into its second position, the trigger 42 is provided with a downwardly projecting boss 158 with a ramp surface 160 thereon that cams against a facing surface 160 on the trip arm 52 of the lifting arm 24.

The foregoing disclosure of specific embodiments is intended to be illustrative of the broad concepts comprehended by the invention.

I claim:

1. A timing apparatus for giving an indication of the passage of a preselected time interval, said apparatus comprising:

a body to be supported on a surface;

a timer mechanism on said body including a trigger that is movable between (a) a set position and (b) a return position;

means on the timer mechanism for moving the trigger from its set position to its return position within a preselected time interval; and means for repositioning the body relative to a support surface for said body as an incident of the trigger moving from its set position into its return position with the body in an operative position on a support surface for the body to give a visual indication of the passage of a preselected time interval

2. The timing apparatus according to claim 1 wherein said repositioning means includes a lifting arm and means for attaching the lifting arm to the body for movement relative thereto between first and second positions, said lifting arm being positionable in said first position with the trigger in its set position, there being cooperating means on the trigger and lifting arm for driving the lifting arm from its first position into its second position as an incident of the trigger moving from its set position into its return position to thereby cause the lifting arm to act against a surface on which the body is supported and thereby reposition the body.

3. The timing apparatus of claim 2 wherein the body has a top side and a bottom side, means are provided on at least one of the lifting arm and body for supporting the timing apparatus in a top side up position relative to a subjacent surface with the lifting arm in its first position and as the lifting arm is caused to be moved from its first position to its second position the lifting arm acting against a subjacent surface flips the timing apparatus over into a bottom side up position on a subjacent support surface.

4. The timing apparatus of claim 2 wherein the trigger moving means includes a spring for normally biasing the trigger towards said return position.

5. The timing apparatus of claim 4 wherein the timer mechanism includes a ratchet means for producing an audible noise indicative of movement of the trigger from said set position to said return position

6. The timing apparatus of claim 2 wherein said lifting arm comprises a U-shaped element defining a U-shaped edge for supporting the timing apparatus on a subjacent support surface with the lifting arm in its first position.

7. The timing apparatus of claim 6 wherein the body has a top side and a bottom side and the top side of the body is substantially flat to make facial engagement with a flat subjacent support surface with the body in a top side down position

8. The timing apparatus of claim 1 wherein means are provided for normally biasing the trigger into its return position

9. The timing apparatus of claim 8 wherein said timer mechanism includes a ratchet means for preventing free movement of the trigger from its set position to its return position.

10. The timing apparatus of claim 9 wherein the ratchet means includes a first rotatable gear with gear teeth and a ratchet arm that acts against the first rotatable gear, said ratchet arm having a nose that moves into and out of engagement with the first rotatable gear between adjacent teeth on the first rotatable gear as the trigger moves between its set position and its return position.

11. The timing apparatus of claim 10 wherein the timer mechanism includes a second gear and a transition gear in mesh between the first and second gears.

12. The timing apparatus of claim 11 wherein the timer mechanism includes a setting gear acting between the trigger and the second gear, there being cooperating means on the second gear and setting gear to allow the setting gear to move in one rotational direction relative to the second gear without moving the second gear and to cause the second gear to follow pivoting movement of the setting gear as the setting gear moves in a rotational direction opposite to the one direction, there being cooperating means on the setting gear and trigger for causing the setting gear to move in the one rotational direction as the trigger is moved from its return position to its set position.

13. The timing apparatus of claim 12 wherein the cooperating means on the setting gear and trigger comprises cooperating teeth and the teeth on the trigger disengage from the setting gear as the trigger approaches its return position to allow the trigger to be positively driven into its return position.

14. The timing apparatus of claim 13 wherein the biasing means comprises a coil spring acting between the body and the trigger.

15. A timing apparatus for giving an indication of the passage of a preselected time interval, said apparatus comprising:

a body to be supported on a surface;

a timer mechanism on the body including a trigger that is movable between (a) a set position and (b) a return position;

means on the timer mechanism for moving the trigger from its set position to its return position within a preselected time interval;

an arm on the body, said arm being movable relative to the body between first and second positions; and means for moving the arm from its first position to its second position as an incident of the trigger moving from its set position to its return position, said arm being exposed outside of the body in its second position and, upon being moved from its first position to its second position, giving a visual indication of the passage of a preselected time interval.

16. The timing apparatus of claim 15 wherein the arm is pivotably connected to the body for movement between its first and second position

17. The timing apparatus of claim 16 wherein the body has an elongate slot and a part of the trigger projects through the slot to allow manual repositioning of the trigger by a user.

18. The timing apparatus of claim 16 wherein with the trigger in its set position the arm is freely movable between its first and second positions without interference from the trigger.

19. The timing apparatus of claim 18 wherein a coil spring biases the trigger towards its return position.

20. The timing apparatus of claim 19 wherein the timer mechanism includes ratchet means for a) preventing free movement of the trigger from its set position to its return position and b) producing an audible clicking noise to alert a user that the timing apparatus is operating.

* * * * *